United States Patent [19]

Graf

[11] 4,217,104

[45] Aug. 12, 1980

[54] PROCESS FOR THE PRODUCTION OF FUR SKINS

[75] Inventor: Hans-Dieter Graf, Eurasburg, Fed. Rep. of Germany

[73] Assignee: Dr. Th. Bohme, Chem. Fabrik GmbH & Co., Isardamm, Fed. Rep. of Germany

[21] Appl. No.: 875,659

[22] Filed: Feb. 6, 1978

[30] Foreign Application Priority Data

Feb. 4, 1977 [AT] Austria ..... 151725/77

[51] Int. Cl.[2] ..... C14C 1/00; C14C 1/08

[52] U.S. Cl. ..... 8/94.14; 8/94.1 D; 8/94.18; 8/94.19 R; 8/94.22

[58] Field of Search ..... 8/94.14, 94.1 D, 94.19 R, 8/94.18, 94.22

[56] References Cited

U.S. PATENT DOCUMENTS

| | | | |
|---|---|---|---|
| 2,523,324 | 9/1950 | Putnam | 8/94.33 |
| 2,781,241 | 2/1957 | Ushakoff | 8/94.18 |
| 3,035,882 | 5/1962 | von Fuchs | 8/94.22 |
| 4,039,281 | 8/1977 | Graf | 8/94.14 |
| 4,147,511 | 4/1979 | Bartlett | 8/94.18 |

FOREIGN PATENT DOCUMENTS

| | | |
|---|---|---|
| 573026 | 11/1945 | United Kingdom . |
| 1138146 | 12/1968 | United Kingdom . |
| 253290 | 2/1970 | U.S.S.R. . |
| 488048 | 1/1976 | U.S.S.R. . |

*Primary Examiner*—A. Lionel Clingman
*Attorney, Agent, or Firm*—Jerry Cohen

[57] ABSTRACT

Fur skin production process comprising treating skins at a stage of processing when they contain 30–80 weight water by immersion in or contact with an organic liquid carrier medium which is water immiscible and not very volatile and contains tanning or further process step chemicals. After tanning or further process steps most of the carrier is removed by centrifuging, squeezing or other physical force process carried out substantially at ambient temperature with little or no heat input. Such processing affords advantages of reduced health hazards and apparatus problems (by avoiding solvent use), reduction of fat liquor and/or kicking oil requirements, reduction of matting on fine wolled skins and avoidance of the need to reverse the skins repeatedly (of skins worked in the round).

10 Claims, No Drawings

PROCESS FOR THE PRODUCTION OF FUR SKINS

The present invention relates to production of fur skins and more particularly to improvements in production methods of the type described in my prior U.S. Pat. No. 4,039,281.

BACKGROUND OF THE INVENTION

U.S. Pat. No. 4,039,281 discloses a process for the production of fur skins in which the skins at a water content of 30 to 80 percent by weight are treated with tanning chemicals present in an organic solvent which is immiscible with water.

This process permits a sharp reduction in the amount of waste waters which are either harmful or difficult to convert to harmless form, and offers other advantages, among them a considerable saving in chemicals. In the production of crude skins worked in the round (i.e., not slit at the belly or back), which are treated in the solvent medium with the hair side turned inward, the skins can however be freed only very slowly, incompletely and with great effort of the solvent medium contained therein or adhering thereto. It is therefore necessary to remove the skins freed by airing of the solvent medium only in the fur leather from the machine with a protective mask, and to turn inside out under a ventilated hood. In the subsequent milling step, the solvent medium can be removed also from the hair, whereupon the pelts are again turned and moved to a kicking processor.

It is an object of the invention to avoid the aforementioned disadvantages without sacrificing the advantages achieved by the process according to U.S. Pat. No. 4,039,281, particularly the solution of the waste water problems.

This object is achieved by treating the skins at a water content of 30 to 80 percent by weight in an organic, water immiscible, liquid, not very volatile carrier medium with tanning chemicals, and after tanning, and possibly other processing, removing the predominant portion of the carrier medium contained in or adhering to the fur skins by centrifuging or squeezing or other physical force process, with little or no heating.

It has molecular weight found that the aforementioned carrier medium for fur skins can be substituted also in other process steps for the solvent medium prescribed in U.S. Pat. No. 4,039,281. Although particular advantages are obtained in using the organic, water-immiscible, not very volatile (high molecular and high boiling), liquid carrier medium specifically for skins worked in the round (espec. fine (noble) fur skins such as muskrat and mink), it is useful also for other fur skins. Because of its lesser volatility, the mentioned carrier medium requires less equipment outlay and can at least partly take the place of fat-liquoring or kicking if it consists of a suitable mineral oil.

Preferably, the carrier medium consists of high molecular weight hydrocarbons (mineral oils), high molecular weight, chlorinated hydrocarbons (especially liquid chloroparaffins) or high molecular weight esters (fatty oils such as triolein or liquid waxes such as sperm oil). After removal, it can be fed to a tank for re-use. The carrier medium in the tank contains substantially no chemicals. To the extent that it carried along water from the pelts, this settles to the bottom of the tank and can be decanted. Since the amount of decanted water which can contain chemical residues is small, their environmentally neutral disposal entails little cost. Upon repeated re-use of the carrier medium, there will be a gradual accretion of natural fats from the skins, but this has no negative effect on the production process.

In contrast to the use of a solvent medium, the described production process considerably simplifies the treatment of skins worked in the round, since twice-repeated turning is obviated, and the skins can be moved directly to the drying and fat-liquoring or kicking stations after centrifuging of the carrier medium. In summary, the following advantages are obtained:

(1) Health hazards and noxious odors resulting from the use of organic solvents are removed.

(2) The necessarily greater outlay for equipment required by the organic solvent is reduced.

(3) Due to the residues of carrier medium remaining in the skin after centrifuging, the amount of fat-liquor or kicking oil can be reduced.

(4) In the case of skins worked in the round, twice-repeated turning is avoided, whereas this is required when a solvent medium is used in order to remove such solvent medium.

(5) In the case of fine wolled skins, the formation of matting is virtually avoided.

DETAILED DESCRIPTION OF PREFERRED EMBODIMENT

The following illustrative, non-limiting example shows a preferred embodiment of practise of the invention.

EXAMPLE 1

Preparation of Muskrat (White Tanning)

10 kg of muskrat skins are soaked, scoured, fleshed and centrifuged until they have a water content of about 50%. The skins are then agitated for 10 minutes in an apparatus such as a fulling or tanning drum having a liquid content capacity of about 120 liters or an operating volume of about 60 liters, together with 50 liters of light mineral oil having a viscosity of 4° E to which 230 g of cooking salt (sodium chloride) has been added.

In place of the fulling or tanning drum, another container having the same liquid content capacity or operating volume, and means for agitating the skins, can be used, as can a dry cleaning machine with a maximum load capacity for solids of 12 kg. A suitable mineral oil is, e.g., "OLEX WT 2577", manufactured by Deutsche Benzin- und Petroleum A. G., Federal Republic of Germany.

Subsequently, 220 g of 85% formic acid is added and agitated for a further 10 minutes. 170 g of powdered potassium aluminum sulfate are then added, followed by 30 minutes agitation, the addition of 100 g of a synthetic tanning material and further agitation of 20 minutes. A suitable tanning material is, e.g., "Tannit AK", manufactured by Dr. Th. Bohme KG, Chem. Fabrik GmbH & Co., Federal Republic of Germany.

Neutralization follows by use of 80 g of sodium hydrogen carbonate in powdered form, and agitation for 15 minutes. The mineral oil is then pumped to a separate tank for re-use. This mineral oil contains insignificant amounts of water, which in turn contains minimal amounts of tanning and pickling chemicals. The water is permitted to settle from the mineral oil in the tank and is then decanted with the chemicals it contains through an outlet in the bottom of the tank.

The skins are then centrifuged (in the apparatus itself if suitably designed), and the centrifuged oil is also led to the aforementioned tank. After their removal, the skins are further processed in the conventional manner, i.e., by drying at a drying station, fat-liquoring or kicking, degreasing and milling.

The skins so processed have a shrinking temperature of about 75° C. and, despite considerable saving of pickling and tanning chemicals, and the avoidance of large amounts of waste water containing such chemicals, are better tanned than skins tanned by conventional water-using processes.

Carrier medium:

(a) High molecular weight hydrocarbons of low viscosity with ≧12 carbon atoms per molecule.

(b) Chlorinated hydrocarbons: Liquid chlorparaffins with ≧16 carbon atoms per molecule and with a chlorine content of 35–70%.

(c) High molecular weight esters. Carbonic acid esters with ≧4 atoms per molecule carbonic acid.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Process for the production of fur skins, comprising steps of treating the skins at a water content of 30–80% by weight in an organic, water-insoluble, substantially non-volatile, liquid carrier medium selected from the group consisting of high molecular weight, high boiling, liquid hydrocarbons, high molecular weight, high boiling, liquid chlorinated hydrocarbons, high molecular weight esters with tanning chemicals insoluble in said carrier medium and removing after completion of tanning or further chemical process step, respectively, the predominant portion of the carrier medium contained in or adhering to said fur skins by a physical force process selected from the class consisting of centrifuging and squeezing.

2. Process according to claim 1, wherein said skins are treated at said water content with pickling chemicals in a liquid carrier medium of said kind.

3. Process according to claim 1, wherein said skins are treated at said water content with neutralizing chemicals in a liquid carrier medium of said kind.

4. Process according to claim 1, wherein said skins are treated with pickling chemicals and said tanning chemicals without changing said organic, water-insoluble, not very volatile, liquid carrier medium.

5. Process according to claim 1, wherein said tanning chemicals are not pre-dissolved in water prior to being added to said carrier medium.

6. Process according to claim 1, wherein said tanning chemicals are dispersed in a water-insoluble, not very volatile liquid prior to being added to said carrier medium.

7. Process according to claim 1, wherein at least said tanning chemicals are pre-dissolved in water prior to being added to said carrier medium, the quantity of water used for pre-dissolving all chemicals being so selected that the total quantity of water employed in the process does not exceed 400 percent by weight of the dry skin material.

8. Process according to claim 1, wherein said skins at a water content of 40 to 70 percent by weight are treated in said carrier medium with tanning and/or retanning chemicals.

9. Process according to claim 1, wherein (i.e. uncut not slit at the belly or back) fine (noble) fur skins are used as raw skins.

10. Process according to claim 9, wherein said raw skins are selected from the group including muskrat, fox and mink.

* * * * *